US006712744B2

(12) United States Patent
Buechel, Jr. et al.

(10) Patent No.: US 6,712,744 B2
(45) Date of Patent: Mar. 30, 2004

(54) REHABILITATION AND FITNESS TRAINER

(75) Inventors: Frederick Buechel, Jr., Naples, FL (US); Colin Hoobler, Beaverton, OR (US)

(73) Assignee: Stabo International LLC, Naples, FL (US)

( * ) Notice: Subject to any disclaimer, the term of this patent is extended or adjusted under 35 U.S.C. 154(b) by 147 days.

(21) Appl. No.: 10/057,021

(22) Filed: Jan. 25, 2002

(65) Prior Publication Data

US 2002/0098954 A1 Jul. 25, 2002

Related U.S. Application Data

(60) Provisional application No. 60/264,169, filed on Jan. 25, 2001.

(51) Int. Cl.[7] ..... A63B 26/00

(52) U.S. Cl. ..... 482/142; 482/141; 280/30

(58) Field of Search ..... 482/141, 142, 482/148; 280/29, 30, 1.5, 648, 250.1, 42; 135/65–67

(56) References Cited

U.S. PATENT DOCUMENTS 277,399 A 5/1883 Worthington
3,410,553 A 11/1968 Safford
3,521,881 A 7/1970 Schaevitz
5,020,560 A * 6/1991 Turbeville ..... 135/67
5,172,715 A * 12/1992 Webb ..... 135/67
5,961,430 A 10/1999 Zuckerman et al.
6,338,493 B1 * 1/2002 Wohlgemuth et al. ..... 280/30

* cited by examiner

*Primary Examiner*—Glenn E. Richman
(74) *Attorney, Agent, or Firm*—Anthony J. Casella; Gerald E. Hespos

(57) ABSTRACT

A portable exercise apparatus for rehabilitation and fitness training comprising horizontal side members attached to a horizontal cross bar. Vertical members extend upward and rearward from a mounting bracket attached to the middle of the cross bar where each vertical member contains a telescoping member for adjusting the height of the apparatus. A U-shaped handle is disposed on top of the telescoping members with a gripping section at each distal end. Each of the vertical and telescoping members have a plurality of apertures for inserting for inserting a locking device therethrough that secures the handle at the desired height. Wheels are attached along one face of the cross bar for ease of movement while a plurality of feet are disposed on the bottom face of the side members for stability and resistance to rolling while the apparatus is in use.

17 Claims, 5 Drawing Sheets

REHABILITATION AND FITNESS TRAINER

This application claims priority based upon U.S. Provisional Application Ser. No. 60/264,169 filed on Jan. 25, 2001.

BACKGROUND OF THE INVENTION

1. Field of the Invention

The subject invention relates to physical fitness devices, and more particularly to devices designed for rehabilitation and fitness training. The rehabilitation and fitness trainer of the subject invention targets senior adults as well as those individuals recovering from major joint surgery (e.g. hip or knee replacement). Furthermore, the subject invention relates to a device that is portable, easy to store and accommodates a wide variety of users.

2. Description of the Related Art

Exercise regimens are necessary for individuals desiring to improve their physical well-being, individuals seeking to maintain their physical health, or those that are recovering from injuries or surgery. Although fitness facilities provide a wide range of equipment to meet those needs, the home-user is limited in his or her equipment choices.

In addition, there is growing concern that senior adults require this type of home exercise more than younger adults. Senior adults are more susceptible to a variety of conditions including osteoporosis, falls, factures and balance control problems. While the conditions pose a risk for anyone, they are especially serious for senior adults who may be alone when the injury occurs and unable to summon for assistance, who incur injuries more easily than younger adults and who also recover more slowly than their younger brethren.

In addition, people recovering from hip or knee replacement surgery require lengthy periods of physical therapy. Usually this is a combination of out-patient physical therapy combined with an in-home exercise regimen. However, due to the limited selection of home equipment available to the patient, home exercise programs are limited in scope.

One such device is the subject of U.S. Pat. No. 5,961,430 that issued to Zuckerman et al. on Oct. 5, 1999. Zuckerman et al. discloses a portable exercise apparatus intended for home use. This exercise apparatus comprises side frames that pivot about a front cross brace for folding into a storage position or unfolding into the operating position. These side frames have a total of four connection points to the support surface and are of a fixed size. Due to the fixed size, the device is not height adjustable for accommodating different sized users. Also, the device has four contact points with the support surface similar to that of a chair. This limited support means leads to a potentially unstable device while in use and can cause the user to fall if the device tips over, thereby defeating a goal of home exercise.

Another related device is disclosed in U.S. Pat. No. 3,410,553 that issued to Safford on Apr. 26, 1966. Safford discloses a structure for rehabilitation of individuals suffering from paraplegia. This device comprises a base with four legs terminating in a circular girt for supporting the patient during rehabilitation. Although this device is height adjustable, the user requires the assistance of another to enter and exit the device since the girt completely encircles the user's body. Also, this device does not include a means for the user to perform a variety of upper body exercises due to the mobility restricting girt.

U.S. Pat. No. 277,399 issued to Worthington on May 8, 1883 disclosed another exercising apparatus. This apparatus has three supporting legs arranged in a triangular pattern, horizontal cross bars and stays connecting the front legs. The device may be disassembled for storage and has an opening for the user to enter, but suffers some of the shortcomings previously mentioned. Worthington's device is not capable of being adjusted to accommodate varying heights of the users. Also, it has only three legs and therefore three contact points on the support surface resulting in a device that may easily become unstable during the user's exercise program.

Finally, U.S. Pat. No. 3,521,881 that issued to Schaevitz on Jul. 28, 1970 discloses another device for exercising. This device comprises a front member, a rear member and two side members that also have the device's vertical elements. A pair of arm rest members are situated at the top of the vertical members with a horizontal bar extending between the arm rests. This device is more stable than others previously discussed but retains some of the disadvantages of the other devices. Since it has a rear support member that contacts the support surface, it is unusable for those individuals confined to a wheelchair. Also, it is not vertically adjustable to accommodate users of differing heights. Furthermore, due to the placement of the horizontal bar and the rectangular frame construction of the side members, users are restricted in the variety of exercises they are capable of performing.

Therefore, it is an object of the subject invention to provide an affordable device for a home exercise program.

It is another object of the subject invention to provide an easy to use device for home exercise.

A further object of the subject invention is to provide a device that is vertically adjustable to accommodate a wide variety of users.

Another object of the subject invention is to provide an exercise device that is easily movable from one location to another.

It is a further object of the subject invention to provide an exercise device that is simple to use and permits wheelchair access.

Yet another object of the object invention is to provide an exercise device that supports a wide variety of exercises.

A further object of the subject invention is to provide an exercise device that is stable throughout all possible exercises.

SUMMARY OF THE INVENTION

The subject invention, that will be commercially known as STABO, overcomes the disadvantages of the prior art by disclosing a new and improved apparatus for exercising at home. This new and improved exercise apparatus comprises a frame having a plurality of side members, a horizontal cross bar, a plurality of vertical members attached to a bracket where each vertical member contains a telescoping member of smaller size, a generally U-shaped handle attached to the tubes and a plurality of wheels attached to the frame. Also, the exercise device will have a plurality of feet on the bottom of the side members to minimize damage to the support surface and increase the stability of the subject invention.

In addition, the subject invention has ergonomic grips at the distal ends of the handle as well as a means for adjusting the vertical dimension of the handle thereby accommodating a wide variety of users.

Since the side members preferably extend both rearwards and sidewards from the horizontal cross bar, the rear opening is spacious enough to permit wheelchair access. An added benefit of this configuration is the increased stability of the exercise device because of the improvement in weight distribution. A further advantage of this configuration is the ability of the user to perform a wide variety of exercises without the physical constraints of the prior art devices.

Other features of the subject invention will be apparent from the subsequent description, the accompanying drawings and the claims.

DETAILED DESCRIPTION OF THE PREFERRED EMBODIMENTS

Figure 1:
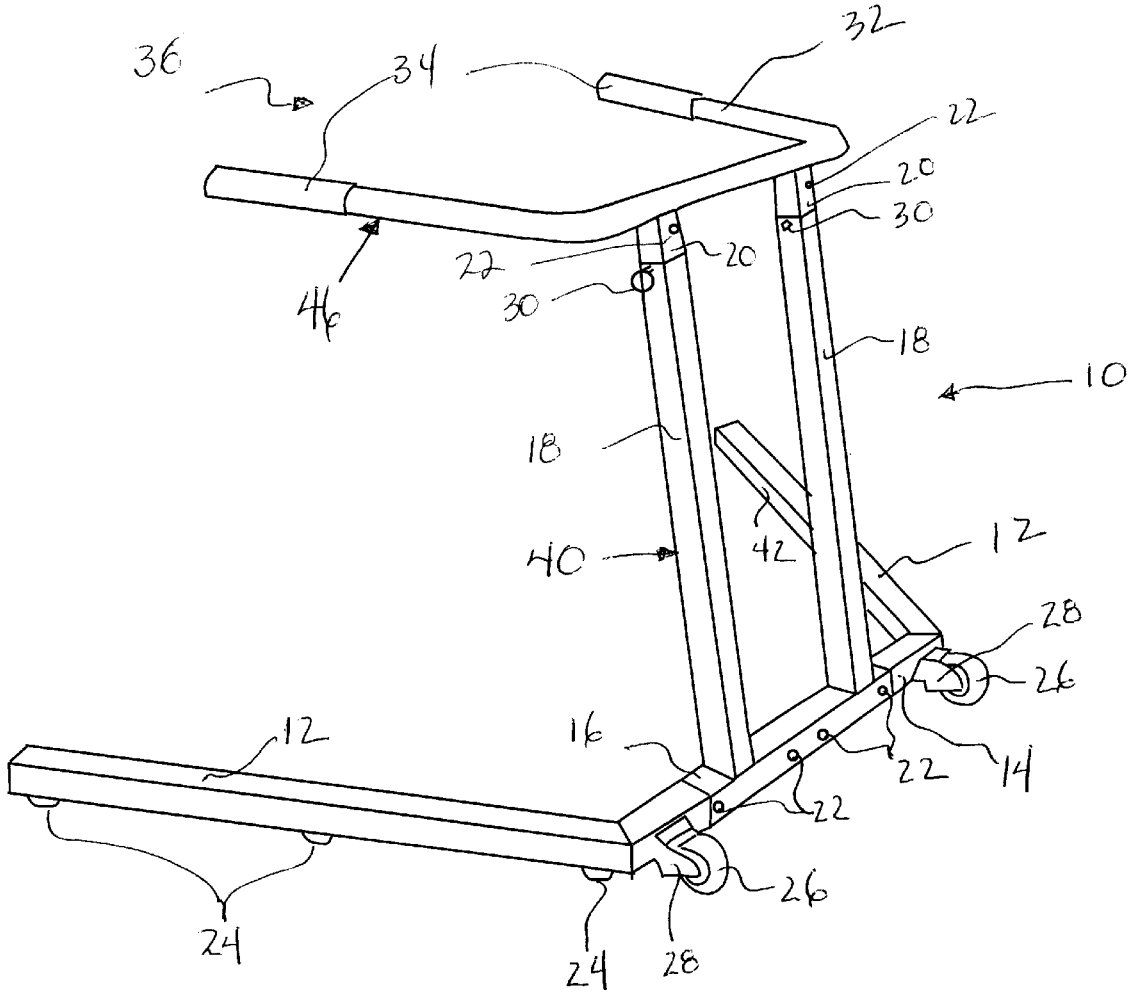
FIG. 1 is a side perspective view of the rehabilitation and fitness trainer of the subject invention.
Figure 2:
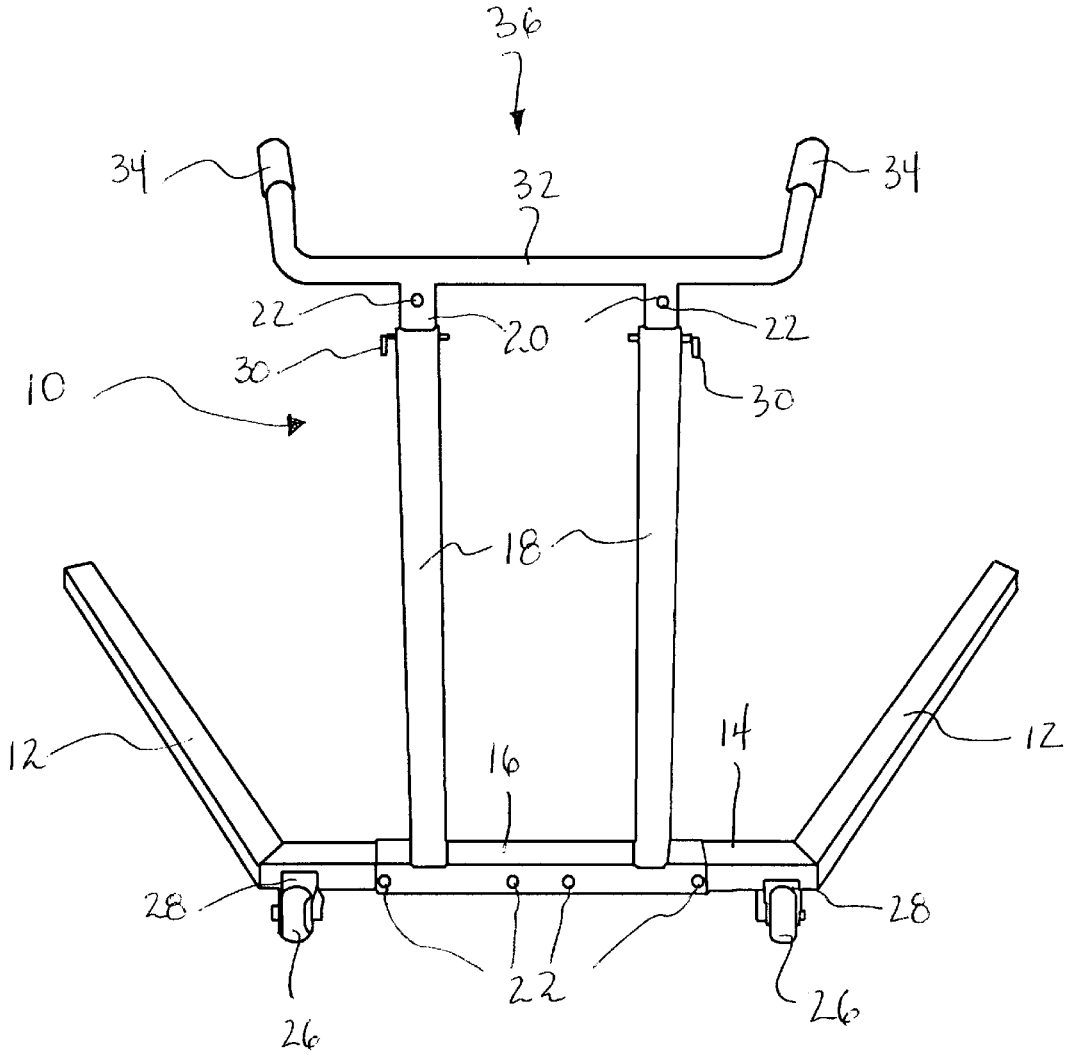
FIG. 2 is a front perspective view of the rehabilitation and fitness trainer of the subject invention.
Figure 3:
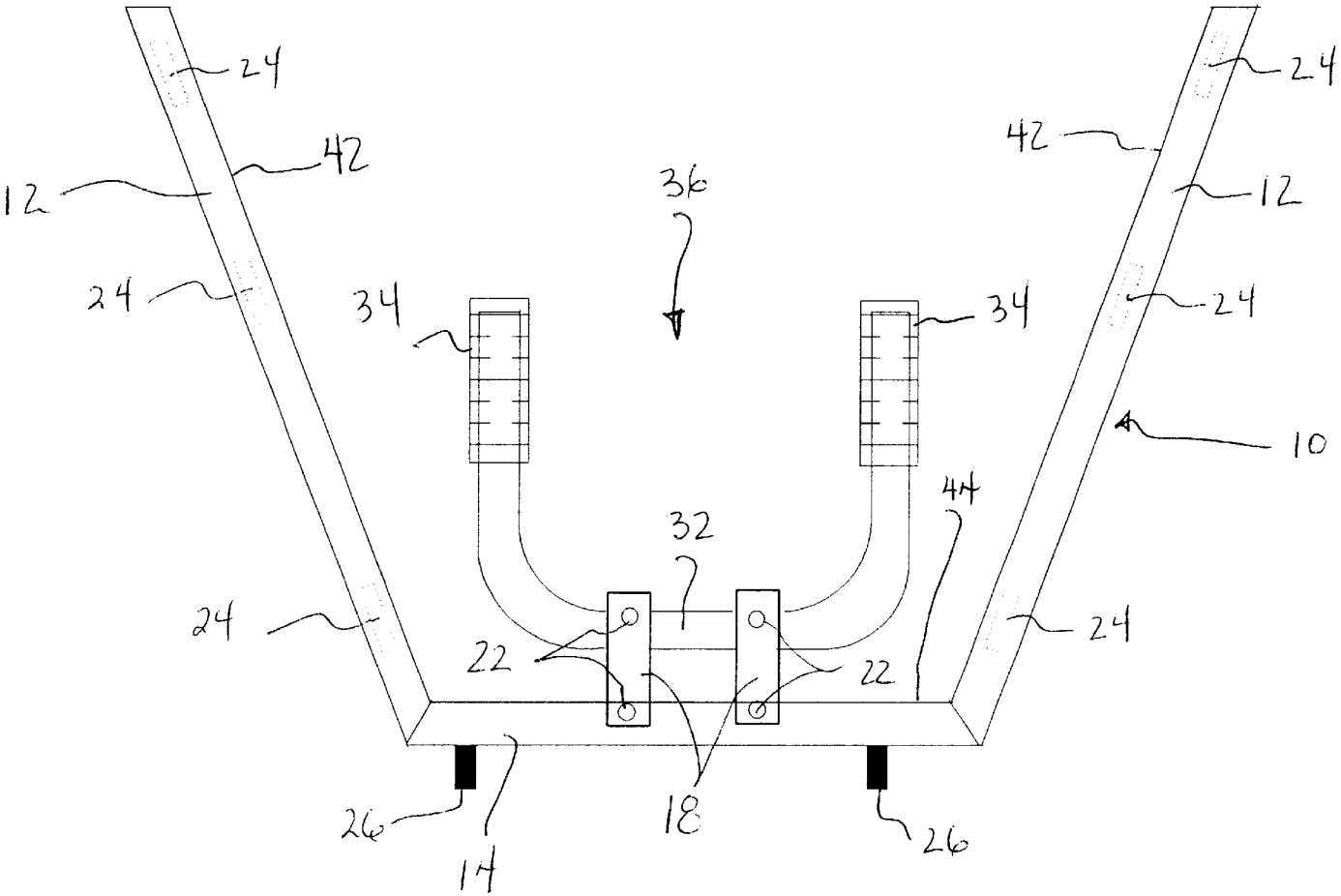
FIG. 3 is a top plan view of the rehabilitation and fitness trainer of the subject invention.
Figure 4:
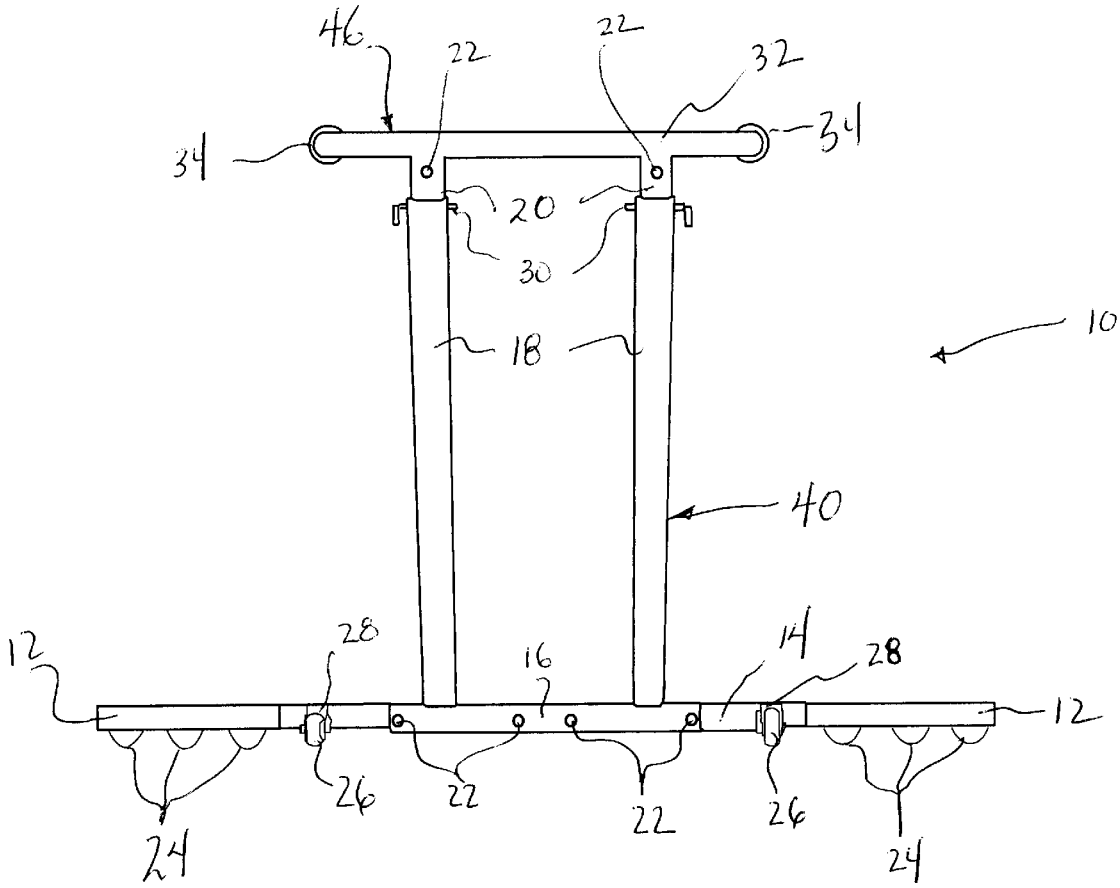
FIG. 4 is a front elevational view of the rehabilitation and fitness trainer of the subject invention.

Referring to the FIGS., the STABO device of the subject invention is referenced by numeral 10. The STABO device 10 of the subject invention is intended for human use to aid in rehabilitation and personal training while providing a stable support mechanism for the individual user. The STABO device 10 is also designed to permit freedom of movement within the STABO device 10 and support the weight of the person using it.

The STABO device 10 comprises a plurality of side members 12 with opposing ends, a cross bar 14 with opposing ends, a bracket 16, a plurality of vertical members 18 and a grip 34. The base frame 40 of the STABO device 10 consists of side members 12, 12, a bracket 16, a cross bar 14 and vertical members 18, 18. Attached to each end of the cross bar 14 is a side member 12. It is preferable that each side member 12 is removably affixed to each end of cross bar. However, permanently attaching side members 12, 12 to the cross bar would still be within the scope of the subject invention. Both side members 12, 12 extend rearward, in the same direction as the open-end 36 of the handle 32. These side members 12, 12 may extend straight back while forming right angles with the cross bar 14. Preferably, the side members 12, 12 will be removably attached to the cross bar 14 and the distal ends of the side members 12, 12 are further apart from each other than the ends of said side members 12, 12 that are connected to the cross bar 14. Furthermore, the side members 12, 12 will preferably form an angle of 100–115 degrees as measured from the inside face 42 of each side member 12 and the rear face 44 of the cross bar 14.

It is preferred that the side members 12, 12 and the cross bar 14 will be of a rectangular tubular design and manufactured from aluminum, steel or any other suitable material that can support the weight of a human body. The side members 12, 12 and cross bar 14 may also be manufactured form a solid block of material and in different shapes such as round, hexagonal or octagonal. A plurality of feet 24 are disposed on the underside of each side member 12 and separate the side member 12 from the support surface of the STABO device 10. These feet 24 help stabilize the STABO device 10 as well as protecting the support surface from damage. The feet 24 are preferably formed from rubber, but may also be made from other suitable cushioning and non-skid materials.

A plurality of wheels 26 and a corresponding number of wheel brackets 28 are fixedly attached to the front face of the cross bar 14 with the rotational orientation of the wheel 26 being perpendicular to the cross bar 14. When an individual is performing exercises, the STABO device 10 is stabilized by the side members 12, 12 the cross bar 14 and the feet 24. The wheels 26 tendency to roll is overcome by the feet 24 and the side members 12, 12. Before or after use, the individual may relocate the STABO device 10 by gripping the handle 32, tipping the STABO device 10 forward so as to lift the feet 24 off of the support surface and applying force in the forward direction. When the feet 24 are not in contact with the support surface, the wheels 26 will rotate freely and permit the STABO device 10 to be easily maneuvered by the user.

Figure 5:
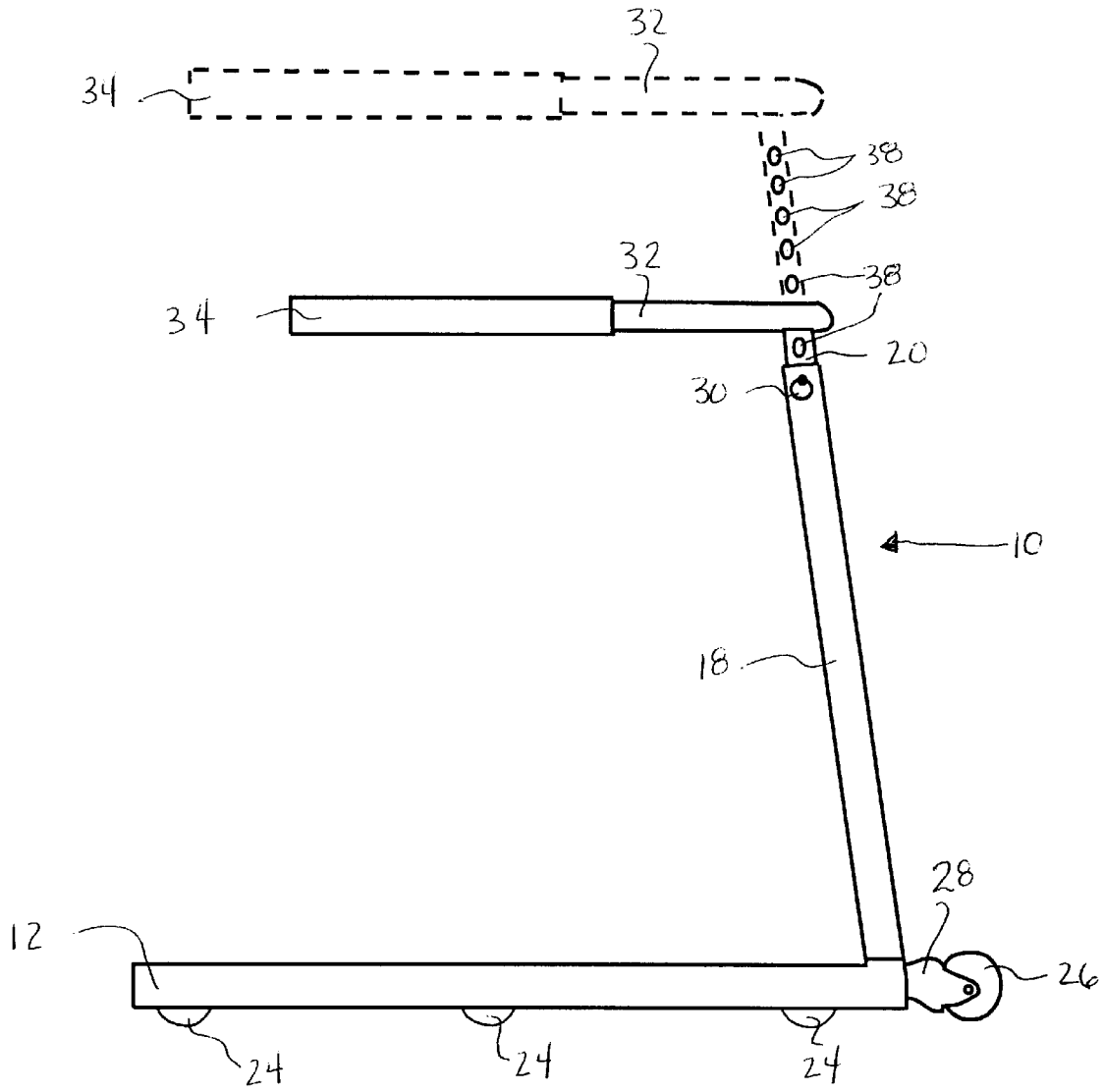
FIG. 5 is a side elevational view of the rehabilitation and fitness trainer of the subject invention.

A bracket 16 is fixedly attached to the cross bar 14 by means of a plurality of fasteners 22. The bracket 16 is attached substantially in the center of the cross bar 14. This forms a symmetrical structure further increasing the overall stability of the STABO device 10. Extending vertically upward from the bracket 16 are a plurality of vertical members 18 formed from steel, aluminum or other suitable material for supporting a human beings weight. These vertical members are tubular and may be rectangular, round, hexagonal or octagonal in shape. Preferably the vertical members 18, 18 are a rectangular tubular construction and substantially parallel to one another. Furthermore, the vertical members 18, 18 are angled slightly in the rearward direction away from the wheels 26. The top of each vertical member 18 is open and a locking device 30 is disposed near the top of each vertical member 18. Each vertical member 18 has a pair of apertures 38 that are circular and substantially parallel to each other so that the locking device 30 may be inserted. These apertures are disposed near the top of the vertical member 18 on the sides of the vertical member 18 that are perpendicular to the cross bar 14. Also, the apertures 38 of each vertical member 18 are substantially parallel to the apertures of the other vertical member 18 to maintain proper horizontal alignment of the handle 32. Attached to the base frame 40 is handle frame 42. The handle frame 46 consists of a handle 32 and telescoping sections 20, 20. The telescoping sections 20, 20 are securably attached to the handle 32. A telescoping member 20 is formed in the same shape as the vertical member 18. Each telescoping member 20 may be either tubular or solid and manufactured from aluminum, steel or any other suitable structural material with the strength to support the user during the exercise routine. Furthermore, the telescoping 20 are of sufficient length so that the STABO device 10 is adaptable to a wide audience of users. The length of the telescoping members 20 will be determined by the length of the vertical members 18. For proper symmetry, each telescoping member 20 will be the same length as the other, while each vertical member 18 will also have the identical length as the other vertical member 18. Additionally, each telescoping member 20 is sized so that it fits inside each vertical member 18 such that there exists sufficient clearance between the telescoping member 20 and the vertical member 18 for freedom of vertical motion. Each telescoping member has a plurality of apertures 38 as seen in FIG. 5. These apertures 38 are substantially circular and evenly spaced along the telescoping member 20, so that they are disposed on the sides of the telescoping member 20 that are perpendicular to the bracket 16. The apertures 38 are disposed along the telescoping member 20 so that each pair of apertures 38 are substantially parallel to each other to permit a locking device 30 to be inserted. The locking device 30 is preferably a rod with a through hole at one end, a ring attached at the opposite end and secured by a cotter pin. However other means of securing the telescoping members 20 to the vertical members 18 may be employed. In the preferred embodiment, when the user adjusts the height of the handle 32, the locking devices 30 are removed by the user, the handle 32 is raised or lowered to the desired height, and the locking devices 30 are inserted through the apertures 38 of the vertical members 18, 18 and the telescoping members 20, 20. The handle 32 is now at the desired height for the user and locked into position.

The handle 32 is preferably a round tubular material such as steel aluminum or another material selected for its strength and is generally U-shaped. It will preferably be formed from the same material as the side members 12. At the free ends of the handle 32, an ergonomic covering of rubber, foam or any other known resilient material is disposed to form a gripping section 34. An open-end 36 exists at the distal ends of the handle 32 between the gripping sections 34, 34. In use, the user will enter the open-end 36 of the STABO device 10 and grasp the gripping section 34 for support while performing their exercises. The open-end 36 is of sufficient size to permit a number of different body sizes to enter and perform their exercises.

The STABO device 10 assists a person who has balance difficulty, has weakness in their lower extremities, or is in a rehabilitation mode following an injury or surgery. The subject invention may also be used by a healthy individual for added support while exercising. The STABO device 10 can be used by an individual at a fitness center, physical therapy center, home gym or any location one would like to place it. It can be used one at a time, or many may be set up and used in an aerobics class format.

While the invention has been described with respect to a preferred embodiment, it is apparent that various changes can be made without departing from the scope of the invention.

What is claimed is:

1. A portable exercise apparatus, for use on a floor, comprising:

a handle frame having a generally U-shaped handle portion, said handle portion having a base member, a first arm and a second arm, said first arm and said second arm being parallel and extending perpendicular to said base member, said handle portion being horizontal to the floor, said handle frame further including two telescoping members attached at an angle to the plane of said U-shaped handle portion, with opposing sides of each said telescoping member having a plurality of spaced apertures;

a generally U-shaped base frame, positioned on said floor, having an elongated cross bar, two side members removably attached to said elongated cross bar and extending rearwardly from said elongated cross bar, said side members extending outwardly relative to each other, each said side member being disposed radially outwardly from said cross bar such that the planar configuration of the base frame is greater than the planar configuration of the handle frame, a mounting bracket attached to said elongated cross bar, said mounting bracket including a pair of elongated members attached to said mounting bracket and extending generally upwardly and rearwardly from said mounting bracket, said elongated members being of hollow construction for telescopically receiving said telescoping members of the handle frame and opposing sides of each said vertical member having a plurality of spaced apertures; and a locking device removably insertable through the aligned apertures to releasably hold said handle frame to said base frame.

2. The apparatus of claim 1, wherein said locking device is a rod with a through hole at one end and a cotter pin to releasably hold said rod in said aligned apertures.

3. The apparatus of claim 2, wherein each said side member forms an angle between 100 and 115 degrees with the longitudinal axis of the elongated cross bar.

4. The apparatus of claim 3, wherein the angle is 105 degrees.

5. The apparatus of claim 4, wherein a pair of wheel brackets is disposed on the front of said elongated cross bar, each said wheel bracket having a wheel.

6. The apparatus of claim 5, wherein the midpoint of the mounting bracket is attached to the midpoint of the elongated cross bar to form a symmetrical structure.

7. The apparatus of claim 6, wherein said side members, said elongated cross bar, said vertical members and said telescoping members are of a rectangular tubular construction.

8. The apparatus of claim 7, wherein a plurality of feet is disposed on the bottom side of each said side member.

9. The apparatus of claim 8, wherein a gripping section at the distal ends of each said arm is covered with a cushioning material.

10. A portable exercise apparatus, for use on a floor, comprising:

a handle frame having a generally U-shaped handle portion, said handle portion having a base member, a first arm and a second arm, said first arm and said second arm being parallel and extending perpendicular to said base member, said handle portion being horizontal to the floor, said handle frame further including two telescoping members attached at an angle to the plane of said U-shaped handle portion;

a generally U-shaped base frame, positioned on said floor, having an elongated cross bar, two side members removably attached to said elongated cross bar and extending rearwardly from said elongated cross bar, said side members extending outwardly relative to each other, each said side member being disposed radially outwardly from said cross bar such that the planar configuration of the base frame is greater than the planar configuration of the handle frame, a mounting bracket attached to said elongated cross bar, said mounting bracket including a pair of elongated members attached to said mounting bracket and extending generally upwardly and rearwardly from said mounting bracket, said elongated members being of hollow construction for telescopically receiving said telescoping members of the handle frame; and an adjusting device for adjusting the vertical dimension between the handle frame and said base frame thereby accommodating a wide variety of users of the apparatus.

11. The apparatus of claim 10, wherein each said member forms an angle between 100 and 115 degrees with the longitudinal axis of the elongated cross bar.

12. The apparatus of claim 11, wherein the angle is 105 degrees.

13. The apparatus of claim 10, wherein a pair of wheel brackets is disposed on the front of said elongated cross bar, each said wheel bracket having a wheel.

14. The apparatus of claim 10, wherein the midpoint of the mounting bracket is attached to the midpoint of the elongated cross bar to form a symmetrical structure.

15. The apparatus of claim 10, wherein said side members, said elongated cross bar, said vertical members and said telescoping members are of a rectangular tubular construction.

16. The apparatus of claim 10, wherein a plurality of feet is disposed on the bottom side of each said side member.

17. The apparatus of claim 10, wherein a gripping section at the distal ends of each said arm is covered with a cushioning material.

* * * * *